United States Patent [19]

Goldfarb et al.

[11] 3,977,121

[45] Aug. 31, 1976

[54] DUAL COMPARTMENT DOLL

[76] Inventors: Adolph E. Goldfarb, 4614 Monarca Drive, Tarzana, Calif. 91356; Erwin Benkoe, 17965 Medley Drive, Encino, Calif. 91316

[22] Filed: Mar. 24, 1975

[21] Appl. No.: 561,270

[52] U.S. Cl. ..... 46/151; 46/159

[51] Int. Cl.[2] ..... A63H 3/00

[58] Field of Search ..... 46/151, 158, 159, 160, 46/156

[56] References Cited

UNITED STATES PATENTS

| | | | |
|---|---|---|---|
| 2,274,303 | 2/1942 | Ornstein | 46/158 |
| 2,540,701 | 2/1951 | Thorpe | 46/151 |
| 3,678,616 | 7/1972 | Goldfarb | 46/151 |
| 3,729,865 | 5/1973 | Naunfeim | 46/159 |

*Primary Examiner*—Louis G. Mancene
*Assistant Examiner*—Jack Q. Lever
*Attorney, Agent, or Firm*—Robert M. Ashen; Robert J. Schaap

[57] ABSTRACT

A doll of the type having a flexible, compliant outer casing or sack of material such as cloth, and which is substantially filled with a solid particulate filler such as beans or plastic beads. The doll of the present disclosure is characterized by having a self-standing main or central upright stack portion which is divided into two separate compartments one disposed vertically above the other. The doll may also have appendages such as arms and a head. By virtue of this arrangement, the particulate material is prevented from shifting to the bottom of the central portion. Such movement of the particulate material out of the top portion of the doll tends to create a distortion of the appearance of the doll and to provide inadequate support for the head. In a particular form of the doll the lower compartment may be filled with heavier material than is the upper compartment, which lowers the center of gravity and makes the doll more stable in its upright position. The two compartments may be provided by the construction of the casing itself or by providing separate interior compartments within the casing.

15 Claims, 4 Drawing Figures

DUAL COMPARTMENT DOLL

Dolls of the bean bag or solid particulate filler variety have become quite popular in recent years. Such dolls comprise generally a soft, compliant, flexible outer skin or casing which may be in the form of a sewn cloth bag, with a body of solid particulate filler material being disposed within the bag, as for example beans or plastic particles. Such solid particulate material tends to flow readily to reposition itself within the soft compliant outer casing and, accordingly, such doll construction has been used to provide for ready reshaping or repositioning of the doll figure by manipulation of the casing to cause movement of the particulate material within the casing from one portion of the casing to another portion of the casing. Reference is made for example to U.S. Pat. No. 3,678,616 to Goldfarb to a partially particulate filled doll capable of multiple positioning of the body as well of the head. Also of note is U.S. Pat. No. 2,997,810 to Bellas, which discloses a loosely filled animal body or main portion to which separate front foot and leg compartments and separate hind foot and leg compartments are attached. The multiple posing capability of the Bellas doll is emphasized while it is apparent that the shifting of material within the main or body/head portion of the doll of Bellas permits it to be placed in a variety of different poses.

The doll construction of the present invention contemplates a relatively stable non-shifting arrangement for the particulate body within the soft outer casing to provide an upright stack or barrel or fire plug type figure having a great deal of stability. This is particularly desirable for pre-school children who have difficulty in manipulating and positioning dolls of more variable configuration. Thus, the doll disclosed in detail hereafter comprises generally a main, upright, self-standing, stack portion having a generally flat lower end of suubstantial size relative to the height of the doll. The doll's stack portion is divided into an upper section and a lower section, with each section being a separate compartment separated from the other compartment to limit flow therebetween of the solid particulate material within the stack portion. The illustrated doll is shown in one form with the outer casing itself formed into two compartments. It is shown in an alternate form where the two interior compartments are formed by a pair of separate bags or containers disposed within the outer casing. It is shown in yet another form where a separate barrier piece is provided. The compartments are substantially occupied by the solid particulate material so that the shape and contour of these compartments are generally maintained by the body of particulate material within them. It is desirable that there be some shiftability of the particulate material within the compartment to provide a good "soft" feel to the doll. The illustrated doll is further porvided with a pair of arms, each terminating in a molded hand, and with a molded head sewn or tied to the casing.

In one form, the invention contemplates the provision of heavier particulate material in the lower section relative to the weight of the particulate material in the upper section. By way of example, the lower section may contain real dried beans, lentils or the like while the upper section may be filled with styrofoam beads or similar material. This arrangement tends to lower the center of gravity and to make the figure more stable in its upright position and easier to handle and to stand up, particularly for younger pre-school children.

The foregoing multi-section stacked arrangement limits the ability of the particulate material to shift from the upper portion of the stack to the lower portion and thereby maintains the integrity of the shape and configuration of the upper portion of the stack. Thus, the doll is prevented from slouching or drooping down into a pyramid-like shape which is unnatural appearing and detracts from the realistic appearance of the doll. Further this arrangement serves to apply force from the particulate material against the underside of the molded head to maintain the head in its desired upright position.

Figure 1:
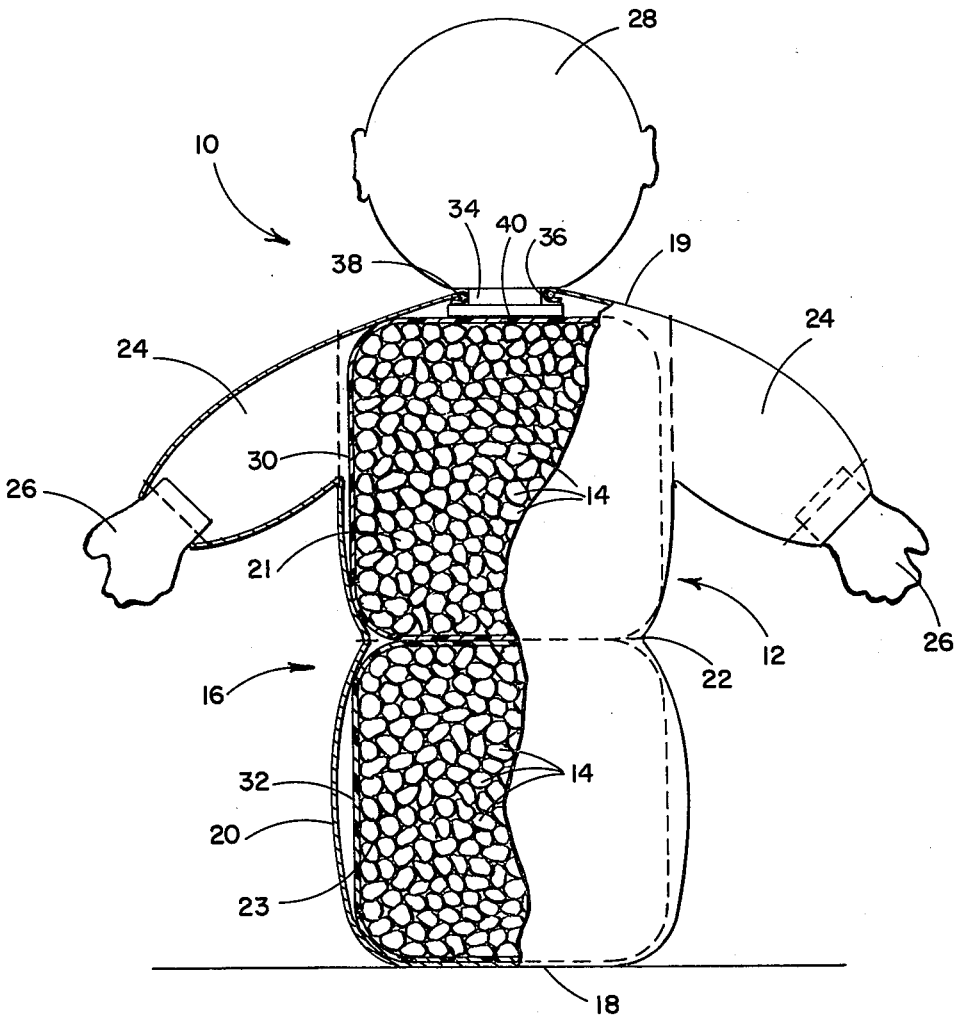
FIG. 1 is a schematic front elevational view taken generally along a side-to-side transverse plane of the doll of FIG. 1.

Broadly, the illustrated doll 10 is of the bean-bag type having a flexible, compliant outer skin or casing 12 of cloth or similar material and containing a body or quantity of solid particulate filler material 14 such as beans, lentils, crushed walnut shells, sytrofoam beads, polyethylene pellets, styrene pellets or similar materials, or a combination of such materials. The illustrated doll has a main central or upright stack portion 16 which has a generally flat and large bottom end 18, an upper end 19, and a generally tubular upright outer wall portion 20. Divider or separator means 22 are provided intermediate the upper and lower ends of the stack portion 16 to separate the stack portion into an upper compartment 21 and a lower compartment 23. Flow of the solid particulate filler material 14 between the two compartments is prevented. The illustrated doll 10 further includes a pair of arms 24, each having a molded hand 26 sewed to its outer end. The doll 10 also has a molded head 28 which is sewn or tied to the outer casing 12 at the upper end 19 of the stack portion 16.

The form of the doll shown in FIG. 1 comprises a pair of separate sealed bags 30, 32 of polyethylene or other suitable material. The bags 30, 32 are stacked on top one another and disposed within the outer casing 16 to form the upper and lower compartments 21 and 23 respectively.

In the illustrated doll 10, the lower compartment 23 contains heavier particulate material as for example, dried beans, lentils, metal beads, glass beads or small marbles, beads or pellets of heavier plastic materials, etc., or some combination thereof. The upper compartment 21 contains relatively lighter particulate material as for example, styrofoam beads, other foamed plastic beads or pellets, etc., or some combination of such materials. Providing heavier material in the lower compartment tends to lower the center of gravity of the doll, giving it greater stability in its upright position.

Figure 1A:
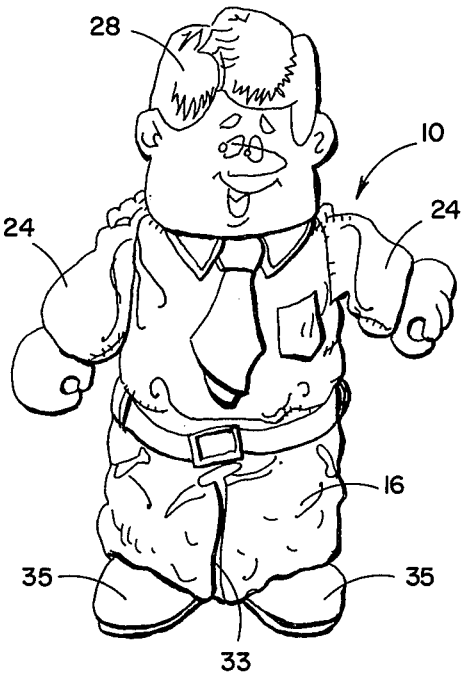
FIG. 1A is a perspective view of a bean-type doll embodying a presently preferred form of the invention.

The doll 10 is designed to stand with its stacked portion 16 upright, its lower end or base 18 resting upon a supporting surface "S" such as a table or the floor. The lower end or base 18 of the stack portion is relatively flat and enlarged as compared to the base normally provided for such bean-type dolls. In addition, a single or unitary base is provided as distinguished from other dolls of this type construction which generally have two legs and feet to provide their bottom or base. It will be noted as shown in FIG. 1A that the lower portion of the stack portion may be provided with indicia 33 which simulate the legs of the doll. Separate simulated feet pieces 35 may also be provided if desired. In the illustrated doll of FIG. 1 the ratio of the minimum transverse dimension of the base of the full height of the doll is about 1:2½, with it being desirable and preferred that the ratio be in the range of from about 1:1½ to 1:3½.

The compartments are relatively full with the particulate material so that they generally maintain their expanded shape and configuration even when handled and manipulated by the childrenusers. There will be some movement of the particulate material within the compartments which gives a desirable soft feel to the doll.

The illustrated head 28 of the doll 10 is provided with a depending neck portion 34 having an annular groove 36 extending around it a short distance from its lower end 40. This in effect forms an annular flange around the lower edge of the neck portion. The neck portion 34 extends down within the body casing 12 centrally of the upper end 19 of the stack portion 16 through an aperture in the casing. The marginal portions of the outer casing around this aperture may be secured to the neck portion 34 as by means of a string or cord 38 secured to such marginal casing portions, the cord being disposed within the annular groove 36 and tied to hold the head 28 casing. It will be noted that the upper end of the upper bag 30 bears against the lower end 40 of the neck portion and thereby serves to maintain the head of the doll in the desired upright position.

Figure 3:
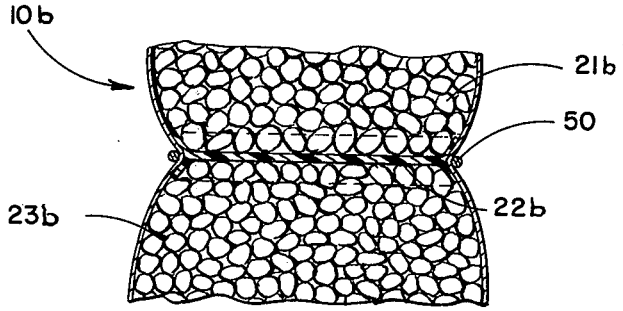
FIG. 3 is a view similar to FIGS. 1 and 2 of the mid or waist portion of another form of doll.

FIG. 3 shows a portion of a doll **10*b* comprising an alternate form of barrier means 22*b* in the form of a separate piece. Barrier means 22*b* is shown as a generally flat circular or oval plate of plastic, cardboard, or other suitable material, having a bifurcated peripheral lip. The adjacent portion of the outer casing may be secured to the lip of the plate 22*b* as by means of an adhesive, stitching or a draw cord 50 as shown in FIG. 3.**

Figure 2:
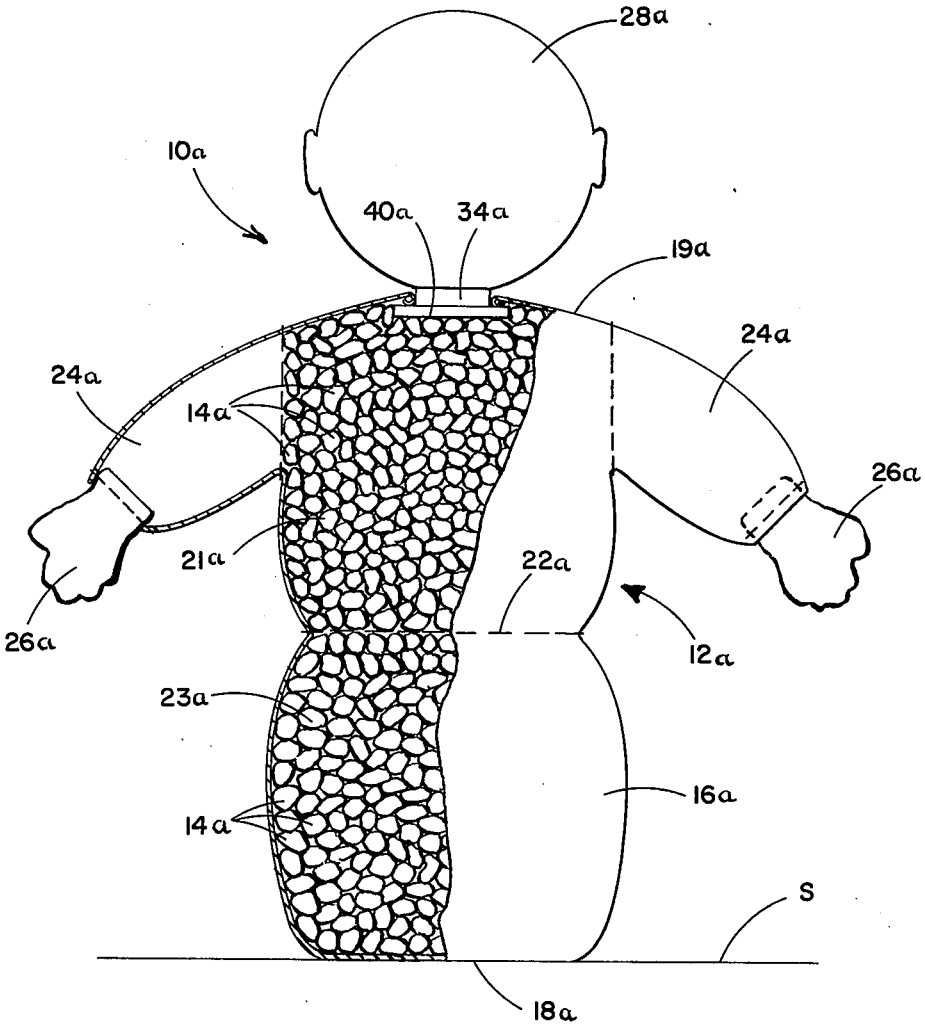
FIG. 2 is a view similar to FIG. 1 of another form of doll.

The doll **10*a* shown in FIG. 2 is generally similar to the doll 10 of FIG. 1, except that the dual compartments are provided by stitching of the outer casing rather than by the provision of separate interior bags or the like. Thus, the outer casing 12*a* of the doll 10*a* may be stitched across at a point along the height of the stack portion 16*a* intermediate the upper and lower end 19*a*, 18*a* to thus form the divider means 22*a* between the upper and lower compartments 21*a*, 23*a*. In the doll 10*a* the casing is also stitched across the upper end of each arm 24*a* to keep the particulate material from entering the arms. In the configuration of FIG. 2, the solid particulate material 14*a* in the upper compartment 21*a* bears directly against the lower end 40*a* of the neck portion 34*a* of the head 28*a*** to serve to maintain the head in its desired upright position.

Various modifications and changes may be made in the details of th illustrated structures without departing from the spirit and scope of the present invention as set forth in the appended claims. For example, the arms and hands may be variously constructed as may the head portion. Further, a great variety of materials may be used for the outer casing, for the solid paticulate material, and for the interior bags or containers if such are utilized. Further, as noted above, the precise means for attaching the head to the body may vary as desired.

We claim:

1. A soft particulate filled doll construction comprising:

a. a flexible, compliant ouoter casing comprising a central upright self-standing stack portion having a generally flat lower end, b. solid particulate filler material disposed within said stack portion so as to substantially occupy said stack portion, and c. divider means disposed intermediate the height of said stack portion for preventing flow of the solid particulate material between an upper area of said stack portion disposed above said divider means and a lower area of such stack portion disposed below said divider means, the particulate material in the lower area being substantially heavier than the particulate material in the upper area.

2. The doll construction of claim 1 wherein said stack portion has an upper end, said doll construction further including a head portion secured to the upper end of said stack portion, said head portion including a downwardly directed surface against which the solid particulate material in the upper area exerts pressure to maintain the head in its upright position.

3. The doll construction of claim 2 wherein said head portion has a downwardly depending neck portion terminating in a generally flat and enlarged lower end to provide said surface against which said pressure from the solid particulate material is exerted.

4. The doll construction of claim 3 wherein said head is a molded part.

5. The doll construction of claim 1 wherein said lighter particulate material comprises styrofoam beads.

6. The doll construction of claim 1 wherein said stack portion casing is formed intermediate its height to define the divider means and the upper and lower areas.

7. The doll construction of claim 1 wherein said outer casing is a cloth fabric and said divider means is in the form of stitching extending across an intermediate portion of the stack portion of said casing.

8. A soft particulate filled doll construction comprising:

a. a flexible, compliant outer casing comprising a central upright self-standing stack portion having a generally flat lower end, b. solid particulate filler material disposed within said stack portion so as to substantially occupy said stack portion, and c. divider means disposed intermediate the height of said stack portion for preventing flow of the solid particulate material between an upper area of said stack portion disposed above said divider means and a lower area of such stack portion disposed below said divider means, said upper and lower areas being defined by separate bags located within said outer casing.

9. The doll construction of claim 8 wherein said bags are made of polyethylene.

10. A soft particulate filled doll construction comprising:

a. a flexible, compliant outer casing comprising a central upright self-standing stack portion having a generally flat lower end, b. solid particulate filler material disposed within said stack portion so as to substantially occupy said stack portion, and c. divider means disposed intermediate the height of said stack portion for preventing flow of the solid particulate material between an upper area of said stack portion disposed above said divider means and a lower area of such stack portion disposed below said divider means, said divider means being a solid separate piece disposed across the interior of said stack portion.

11. The doll construction of claim 10 wherein said barrier piece is a generally flat plate having a peripheral edge, said edge being secured to said outer casing.

12. The doll construction of claim 1 wherein the ratio of the minimum transverse dimension of the base of said stack portion to the height of the doll is no less than about 1:2.

13. The doll construction of claim 1 wherein the ratio of the minimum transverse dimension of the base of the stack portion to the height of the doll is within the range of from about 1:1½ to about 1:3½.

14. The doll construction of claim 2 further including a pair of opposed arms portions.

15. A bean-type doll construction having high stability comprising:

a. an outer casing of a soft compliant, flexible material, said outer casing defining an upright, self-standing, generally cylindrical stack portion having a generally flat enlarged lower end, an upper end, and a generally annular side wall, b. solid particulate material disposed within said stack portion, c. a head portion secured to the upper end of said stack portion and including a downwardly facing surface at the upper end of said stack portion, and d. means defining a barrier extending transversely across said stack portion intermediate its upper and lower ends for dividing said stack portion into separate upper and lower compartments so as to prevent movement of solid particulate material between said compartments, said compartments being sufficiently filled with said particulate material to cause said stack portion to maintain its shape and to cause a force to be exerted against said downwardly facing head surface, the solid particulate material in the upper compartment being substantially lighter weight than the solid particulate material in the lower compartment.

* * * * *